US007802792B2

(12) United States Patent
Mizutani

(10) Patent No.: US 7,802,792 B2
(45) Date of Patent: Sep. 28, 2010

(54) IMAGE FORMING APPARATUS

(75) Inventor: Naoki Mizutani, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 69 days.

(21) Appl. No.: 12/320,651

(22) Filed: Jan. 30, 2009

(65) Prior Publication Data

US 2009/0194938 A1 Aug. 6, 2009

(30) Foreign Application Priority Data

Feb. 6, 2008 (JP) ..... 2008-025854

(51) Int. Cl.
*B65H 7/14* (2006.01)

(52) U.S. Cl. ..... 271/258.01; 271/258.04; 271/176; 399/400

(58) Field of Classification Search ..... 271/258.01, 271/258.04, 176; 399/400
See application file for complete search history.

(56) References Cited

U.S. PATENT DOCUMENTS

2004/0131399 A1* 7/2004 Sahara ..... 399/322
2009/0297242 A1* 12/2009 Kanematsu ..... 399/400
2009/0304398 A1* 12/2009 Shimizu ..... 399/21
2009/0304426 A1* 12/2009 Nakagaki ..... 399/400
2010/0061741 A1* 3/2010 Minbu ..... 399/21

FOREIGN PATENT DOCUMENTS

JP 11-59962 3/1999

* cited by examiner

*Primary Examiner*—David H Bollinger
(74) *Attorney, Agent, or Firm*—Smith, Gambrell & Russell, LLP

(57) ABSTRACT

An image forming apparatus 1 has an intermediate transfer belt 17 that rotates in synchronization with the operation of a photoconductive section 11 where a toner image is formed, and a secondary transfer section S at which paper P temporarily adhering to a surface of this intermediate transfer belt 17 can be separated from the surface of the intermediate transfer belt 17. The image forming apparatus 1 is provided with a distance detecting unit 66 that detects a distance "L" to the paper P sent out from this secondary transfer section S, and a control section 74 that judges whether or not the paper P is normally separated from the secondary transfer section S based on distance data fed from this distance detecting unit 66.

14 Claims, 3 Drawing Sheets

IMAGE FORMING APPARATUS

This application is based on Japanese Patent Application No. 2008-025854 filed on Feb. 6, 2008, the contents of which are hereby incorporated by reference.

BACKGROUND OF THE INVENTION

1. Field of the Invention

The present invention relates to image forming apparatuses employing an electrographic method, such as copiers, printers, facsimiles, and multifunctional machines having these functions. The present invention particularly relates to image forming apparatuses provided with a belt-shaped rotatable member functioning as an intermediate transfer member, a paper transporting member, and the like.

2. Description of Related Art

Conventional examples of image forming apparatuses include ones in which paper is transported by being electrostatically adhered to a belt-shaped or a drum-shaped paper transporting member that rotates in synchronization with an image forming member such as a photoconductive member, and the paper is then separated from the paper transporting member to be sent to a fixing device after a toner image is transferred thereonto from the image forming member. Conventional examples of image forming apparatuses also include ones in which a toner image formed on an image forming member is primarily transferred onto a belt-shaped or a drum-shaped intermediate transfer member that rotates in synchronization with the image forming member, the toner image transferred onto the intermediate transfer member is then transferred at a secondary transfer section onto paper that is fed temporarily adheres to the intermediate transfer member, and the paper is then separated from the intermediate transfer member to be sent to a fixing device. In these image forming apparatuses, paper jams sometimes occur due to the paper onto which an image has been transferred failing to be separated from the paper transporting member or from the intermediate transfer member (which will be collectively called a "belt-shaped rotatable member") to remain adhered to the belt-shaped rotatable member, or due to abnormal transportation of the paper. For the purpose of detecting occurrence of such paper jams, some conventional image forming apparatuses are provided with paper detecting means for detecting whether or not paper remains adhered to the belt-shaped rotatable member without being separated therefrom at a separation section of the belt-shaped rotatable member.

For example, JP-A-H11-59962 discloses an image forming apparatus in which a jam sensor is arranged on a paper-introduction side of a fixing device to detect passing of paper that is transported from an intermediate transfer member to the paper-introduction side of the fixing device. Furthermore, separation failure detecting sensor is arranged close to a surface of the intermediate transfer member to detect whether or not paper remains adhered to the surface of the intermediate transfer member without being separated therefrom after a secondary transfer. This separation failure detecting sensor is a reflection-type sensor that irradiates the surface of the intermediate transfer member with light from a light-emitting element and receives the light reflected from the surface of the intermediate transfer member with a light-receiving element; presence of paper remaining adhered to the surface of the intermediate transfer member is detected based on variation in output value of the separation failure detecting sensor. Here, these sensors are set such that, when the jam sensor has not detected passing of paper within a predetermined time period, a jam is judged to have occurred, and when the separation failure detecting sensor has detected presence of paper remaining adhered to the surface of the intermediate transfer member, separation failure is judged to have occurred, and in both cases, operation of the whole apparatus is immediately stopped.

However, with the just-mentioned conventional technology, although it is possible to detect whether or not paper remains adhered to the surface of the intermediate transfer member by use of the separation failure detecting sensor, it is impossible to detect that paper, although it is slightly separated from the intermediate transfer member, is moving toward the paper introduction side of the fixing device in an inappropriate position. Paper in such a case may hit or rub against members and units such as a cleaning member for removing toner remaining on the intermediate transfer member that are arranged on a downstream side of a separation section at which paper is separated, with respect to a paper transportation direction, and this may disturb an image formed on the paper. Furthermore, if paper rushes into the fixing device in an inappropriate position, the paper becomes wrinkled to cause a jam, which is inconvenient. Moreover, the jam sensor arranged on the paper introduction side of the fixing device cannot detect occurrence of a jam even when the wrinkled paper rushes into the fixing device, which is also inconvenient.

SUMMARY OF THE INVENTION

The present invention has been made to solve the above problems, and an object of the present invention is to provide an image forming apparatus capable of detecting, with a simple structure, various types of paper separation failure such as paper remaining adhered to a belt-shaped rotatable member and paper being slightly separated from the belt-shaped rotatable member.

To achieve the above object, according to the present invention, an image forming apparatus includes: a belt-shaped rotatable member that rotates in synchronization with operation of an image forming member on which an image is formed; a separation section at which paper adhered to a surface of the belt-shaped rotatable member can be separated from the surface of the belt-shaped rotatable member; a distance detecting unit that detects a distance to paper sent out from the separation section; and a control section that judges, based on distance data fed from the distance detecting unit, whether or not paper is appropriately separated from the separation section.

With this structure, it is possible to detect, based on the data of the distance to the paper sent out from the separation section, not only paper remaining adhered to the belt-shaped rotatable member at the separation section but also paper being slightly separated from the belt-shaped rotatable member, and this makes it possible to securely judge various types of paper separation failure occurring at the separation section.

According to the present invention, it is preferable that, in the image forming apparatus structured as described above, the distance detecting unit include: a light projector that projects light toward paper; and a photodetector that receives light reflected from the paper, and that the distance detecting unit detect a distance to the paper based on a position in the photodetector at which the light reflected from the paper is received.

With this structure, it is possible to detect an accurate distance to the paper.

According to the present invention, it is preferable that, in the image forming apparatus structured as described above, the control section make the belt-shaped rotatable member stop rotating when the distance data is out of a predetermined range.

If the distance data is out of the predetermined range, it means that the paper remains adhered to the belt-shaped rotatable member at the separation section, or that the paper is likely to hit or rub against members and units arranged in a vicinity of a paper transportation path between the separation section and where a next process is performed. With the structure of the present invention, the control section makes the belt-shaped rotatable member stop rotating according to the detection result, and this makes it possible to deal with various types of jams. In addition, it is possible to reduce space necessary for allowing paper to avoid hitting or rubbing against members and units arranged in the vicinity of the paper transportation path, and thus to make the apparatus compact.

According to the present invention, it is preferable that, in the image forming apparatus structured as described above, the control section display an alert on a control panel when the distance data is out of a predetermined range.

If the distance data is out of the predetermined range, it means that the paper remains adhered to the belt-shaped rotatable member at the separation section, or that the paper is likely to hit or rub against the members and the units arranged in the vicinity of the paper transportation path between the separation section and where the next process is performed. With the structure of the present invention, the control section displays the alert on the control panel according to the detection result to help the user visually recognize various jams via the control panel, and this makes the apparatus more user-friendly.

According to the present invention, it is preferable that, in the image forming apparatus structured as described above, the belt-shaped rotatable member be an intermediate transfer belt onto which a toner image formed on the image forming member is primarily transferred, and that the separation section be a secondary transfer section where a toner image on the intermediate transfer belt is secondarily transferred onto paper.

With this structure, based on the distance data of a distance to paper sent out from the secondary transfer section, it is possible to detect not only paper remaining adhered to the secondary transfer belt but also paper being slightly separated from the intermediate transfer belt, and thereby to easily judge various types of paper separation failure occurring at the secondary transfer section.

According to the present invention, it is preferable that, in the image forming apparatus structured as described above, the distance detecting unit be placed in a vicinity of the separation section.

With this structure, detection of abnormal paper transportation can be performed as soon as the paper is sent out from the secondary transfer section, and thus paper is prevented from being sent to a place from which it is difficult to remove paper, and this makes it easy to deal with a jam.

According to the present invention, it is preferable that, in the image forming apparatus structured as described above, a belt cleaning unit for removing residual toner remaining on a surface of the intermediate transfer belt after a secondary transfer be placed in a vicinity of the secondary transfer section, and that the distance detecting unit be placed between the secondary transfer section and the belt cleaning unit.

With this structure, a position of paper is detected before the paper hits or rubs against the belt cleaning unit, and this makes it easy to deal with a jam.

According to the present invention, it is preferable that, in the image forming apparatus structured as described above, the distance detecting unit be arranged so as to be perpendicular to a plane defined by the secondary transfer section and a lower edge of the belt cleaning unit.

With this structure, the distance detecting unit detects a distance to paper that is likely to hit or rub against the belt cleaning unit in a direction perpendicular to paper, and thus can detect an accurate distance to the paper; this helps improve accuracy of judgment on whether or not the paper is likely to hit or rub against the belt cleaning unit.

According to the present invention, it is preferable that, in the image forming apparatus structured as described above, a transportation guide be provided for guiding paper sent out from the separation section toward a fixing device, and that the distance detecting unit detect a distance to paper while the paper is present between the separation section and a position where the paper is guided by the transportation guide.

With this structure, abnormal paper transportation can be detected while an end of the paper is present between the separation section and the transportation guide, and thus the paper is prevented from being sent to a position from which it is difficult to remove paper, which makes it easy to deal with a jam.

According to the present invention, it is preferable that, in the image forming apparatus structured as described above, the control section make the belt-shaped rotatable member stop rotating when the distance data is out of a predetermined range.

If the distance data is out of the predetermined range, it means that the paper remains adhered to the intermediate transfer belt at the separation section, or that the paper is likely to hit or rub against members and units arranged in the vicinity of the paper transportation path between the separation section and where the next process is performed. With the structure of the present invention, the control section makes the belt-shaped rotatable member stop rotating according to the detection result, and this makes it possible to reduce space provided for allowing the paper to avoid hitting or rubbing against members and units arranged in the vicinity of the paper transportation path, and thus a compact apparatus can be achieved.

According to the present invention, it is preferable that, in the image forming apparatus structured as described above, the belt-shaped rotatable member transport paper toward the image forming member to further transport the paper to the separation section after a toner image is transferred onto the paper from the image forming member.

With this structure, although the belt-shaped rotatable member functions as a paper transportation member, it is possible to detect not only paper remaining adhered to the belt-shaped rotatable member at the separation section but also paper being slightly separated from the belt-shaped rotatable member, and thus various types of paper separation failure occurring at the separation section can be easily detected.

DETAILED DESCRIPTION OF PREFERRED EMBODIMENTS

Hereinafter, a description will be given of embodiments of the present invention with reference to the accompanying drawings, but the embodiments are not meant to limit the present invention. The embodiments of the present invention show the most preferable forms of the present invention, and the application of the present invention and terms used in the description should not be interpreted in a limited manner.

Figure 1:
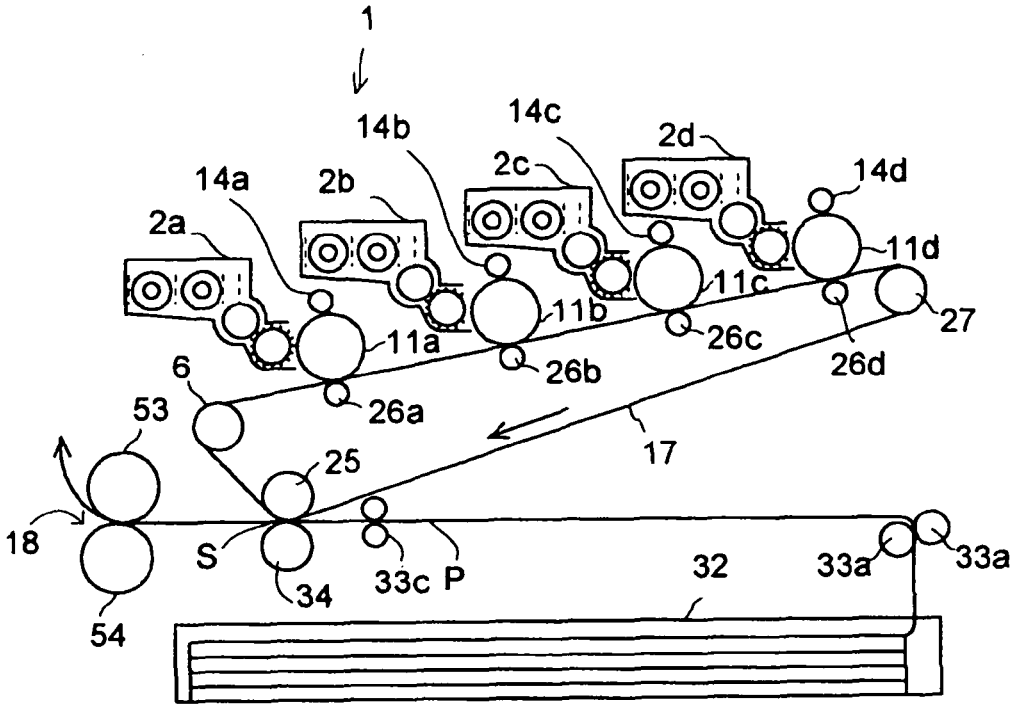
FIG. 1 is a sectional front view schematically showing a structure of an image forming apparatus embodying the present invention.

FIG. 1 is a sectional front view schematically showing a structure of an image forming apparatus embodying the present invention, in which a belt-type rotatable member is used as an intermediate transfer belt. An image forming apparatus 1 is a tandem type color printer, including photoconductive members 11*a* to 11*d* formed as rotatable image forming members. The photoconductive members 11*a* to 11*d* each have a photoconductive layer formed of an organic photoconductor (OPC) as a photoconductive material, and are arranged so as to correspond to colors of black (B), yellow (Y), cyan (C), and magenta (M). The photoconductive layer may be formed of amorphous silicon. In the vicinity of each of the photoconductive members 11*a* to 11*d*, developing units 2*a* to 2*d* and chargers 14*a* to 14*d* are arranged, respectively, in addition to an exposure unit (not shown).

The developing units 2*a* to 2*d* are placed to the left of and facing the photoconductive members 11*a* to 11*d*, respectively, and supply toner to the photoconductive members 11*a* to 11*d*, respectively. The chargers 14*a* to 14*d* are placed on upstream sides of the developing units 2*a* to 2*d* with respect to a rotation direction of the photoconductive members 11*a* to 11*d*, so as to face surfaces the photoconductive members 11*a* to 11*d*, respectively, and uniformly charge the surfaces of the photoconductive members 11*a* to 11*d*, respectively. Dischargers (omitted in the figure) are provided to discharge residual charge remaining on the photoconductive members 11*a* to 11*d* after development.

According to image data representing letters, pictures, and the like fed to an image receiving section (omitted in the figure) from a personal computer or the like, surfaces of the photoconductive members 11*a* to 11*d* are irradiated with laser light by the exposure units, and thereby electrostatic latent images are formed on the surfaces of the photoconductive members 11*a* to 11*d*. These electrostatic latent images are developed into toner images by the developing units 2*a* to 2*d*.

An intermediate transfer belt 17 is wound around a tension roller 6, a driving roller 25, and a driven roller 27 under tension. The photoconductive members 11*a* to 11*d* are arranged, over and in contact with the intermediate transfer belt 17, to be adjacent to one another, from an upstream side along a transportation direction (indicated by an arrow in FIG. 1). Primary transfer rollers 26*a* to 26*d* are arranged so as to face the photoconductive members 11*a* to 11*d*, respectively, with the intermediate transfer belt 17 therebetween, and they are in contact with the intermediate transfer belt 17. The primary transfer rollers 26*a* to 26*d* are movable in an up/down direction in FIG. 1, and thus can be pressed against the photoconductive members 11*a* to 11*d*, respectively, via the intermediate transfer belt 17 to form primary transfer nips to be released thereafter, as necessary. At the primary transfer nips, the toner images formed on the photoconductive members 11*a* to 11*d* are transferred onto a surface of the intermediate transfer belt 17. As the intermediate transfer belt 17 rotates, the toner images formed on the photoconductive members 11*a* to 11*d* are transferred onto the intermediate transfer belt 17 one after another, and thereby is formed a full color toner image in which the toner images of the four colors of cyan, magenta, yellow, and black are superposed one on top of another.

A secondary transfer roller 34 is provided facing the driving roller 25 with the intermediate transfer belt 17 placed therebetween, and the secondary transfer roller 34 is pressed against the intermediate transfer belt 17 to form a secondary transfer section S. At this secondary transfer section S, the toner image formed on the surface of the intermediate transfer belt 17 is transferred onto paper P.

At a bottom inside the image forming apparatus 1, a paper feeding cassette 32 is arranged for accommodating the paper P. The paper feeding cassette 32 can be pulled out of the apparatus (toward the front side in FIG. 1) so as to be refilled with paper, and the paper P accommodated therein is sent toward the secondary transfer section S one sheet after another by a pickup roller and a sorting roller 33*a*.

A resist roller 33*c* transports the paper P to the secondary transfer section S at a timing in accordance with image forming operation at the intermediate transfer belt 17 and paper feeding operation. Onto the paper P delivered to the secondary transfer section S, the full-color toner image formed on the intermediate transfer belt 17 is secondarily transferred by the secondary transfer roller 34 to which a bias voltage of polarity opposite to polarity of charge of the toner is applied; then, the paper P is transported to a fixing device 18.

The fixing device 18 is placed on a downstream side of the secondary transfer section S with respect to a paper transporting direction, has a fixing roller 53 to which heat is applied by a heater and a pressure roller 54 arranged to be pressed against the fixing roller 53, and performs fixing by applying heat and pressure to the paper P on which the toner image has been transferred. The paper P is ejected out of the apparatus by an ejection roller after being subjected to fixing at the fixing device 18.

Figure 2:
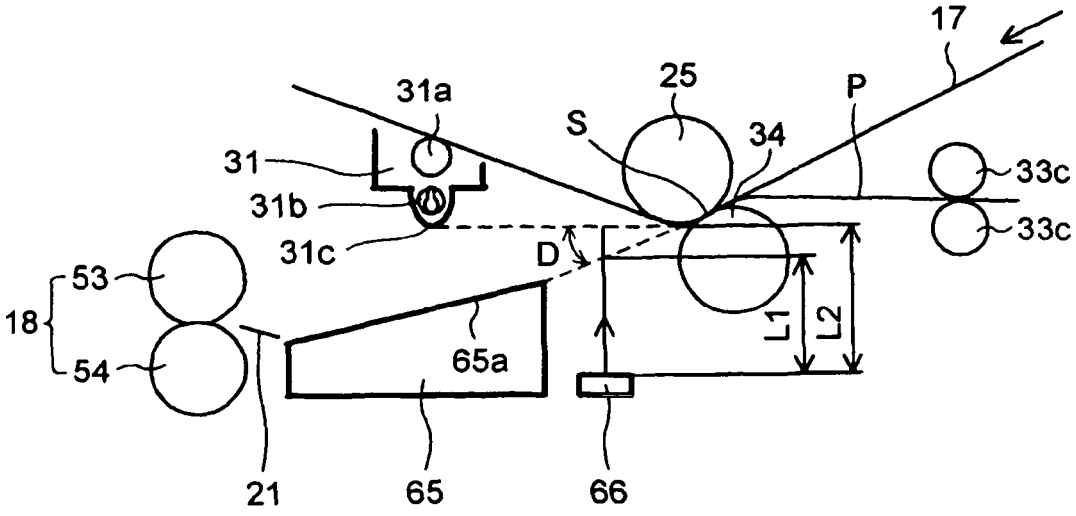
FIG. 2 is a sectional front view of a main part of the image forming apparatus embodying the present invention showing an arrangement of a distance detecting unit and a detection state for detecting a distance to paper.

FIG. 2 is a sectional front view showing an arrangement of a distance detecting unit and a detection state for detecting distance to paper.

As shown in FIG. 2, the secondary transfer roller 34 that is pressed against the driving roller 25 and rotated thereby, a belt cleaning unit 31, a transportation guide 65, and a distance detecting unit 66 are arranged in the vicinity of the intermediate transfer belt 17. The driving roller 25 is formed as a roller having a diameter of approximately 30 mm. On a downstream side of the secondary transfer section S with respect to a direction indicated by an arrow in the figure, the intermediate transfer belt 17 runs along a path inclined at an angle of 45 degrees or larger with respect to a tangent line direction at a nip between the driving roller 25 and the secondary transfer roller 34. With this structure, the paper P sent out from the secondary transfer section S is separated from the intermediate transfer belt 17 due to, for example, rigidity of the paper P.

The belt cleaning unit 31 removes residual toner remaining on the surface of the intermediate transfer belt 17 after transfer, and is arranged at a position that is closest to the secondary transfer section S on the downstream side of the secondary transfer section S with respect to a rotation direction of the intermediate transfer belt 17. This belt cleaning unit 31 has a cleaning brush 31*a* that is supported in a casing of the belt cleaning unit 31 and an exhaust screw 31*b*. When cleaning of the surface of the intermediate transfer belt 17 is started, a cleaning bias of polarity that is opposite to the polarity of the charge of the toner is applied to the cleaning brush 31*a*, and the cleaning brush 31*a* comes in contact with the surface of the intermediate transfer belt 17. This makes the residual toner remaining on the surface of the intermediate transfer belt 17 move from the intermediate transfer belt 17 toward the cleaning brush 31*a* to be collected by the exhaust screw 31*b*.

The transportation guide 65 guides the paper P that has been subjected to a transfer operation from the secondary transfer section S toward the fixing device 18, and is arranged below and to the left of the secondary transfer section S, between the secondary transfer section S and the fixing device 18, and has a slope portion 65*a* formed as a slope descending along the paper transportation direction toward the fixing device 18. The paper P sent out from the secondary transfer section S is received by the slope portion 65*a* and is guided via the pre-fixing guide 21 toward a nip between the fixing roller 53 and the pressure roller 54. The belt cleaning unit 31 is arranged above the transportation guide 65.

A range between broken lines in FIG. 2 is a normal transportation range D of the paper P sent out from the secondary transfer section S. This range between the broken lines is an area between two boundaries, that is, a lower boundary extending between a top end of the slope 65*a* of the transportation guide 65 and the secondary transfer section S and an upper boundary extending between a bottom end 31*c* of the casing of the belt cleaning unit 31 and the secondary transfer section S. Here, the belt cleaning unit 31 is placed such that the upper boundary is horizontal in FIG. 2. If an edge of the paper P that has passed through the secondary transfer section S is out of this range, it means that the paper P is not normally delivered to the pre-fixing guide 21 of the fixing device 18. In particular, is the edge of the paper P is above the upper boundary, it means that the paper P remains adhered to the intermediate transfer belt 17 without being separated therefrom at the secondary transfer section S, or that, although the paper P is separated from the secondary transfer section S, the paper P is likely to hit or rub against the belt cleaning unit 31. Such separation failure of the paper P may cause the paper P to be wrinkled, and may further cause a jam.

The distance detection unit 66 detects a position of the paper P sent out from the secondary transfer section S in order to judge whether or not the paper P is within the normal transportation range described above. To achieve this, the distance detecting unit 66 is arranged below the normal transportation range of the paper P, perpendicular to a plane including the upper boundary, between the secondary transfer section S and the belt cleaning unit 31, and next to the transportation guide 65. When the distance detecting unit 66 detects a distance to the paper P sent out from the secondary transfer section S and the detected distance is between a distance L1 to the lower boundary and a distance L2 to the upper boundary, it means that the paper P has been normally sent out from the secondary transfer section S.

Figure 3:
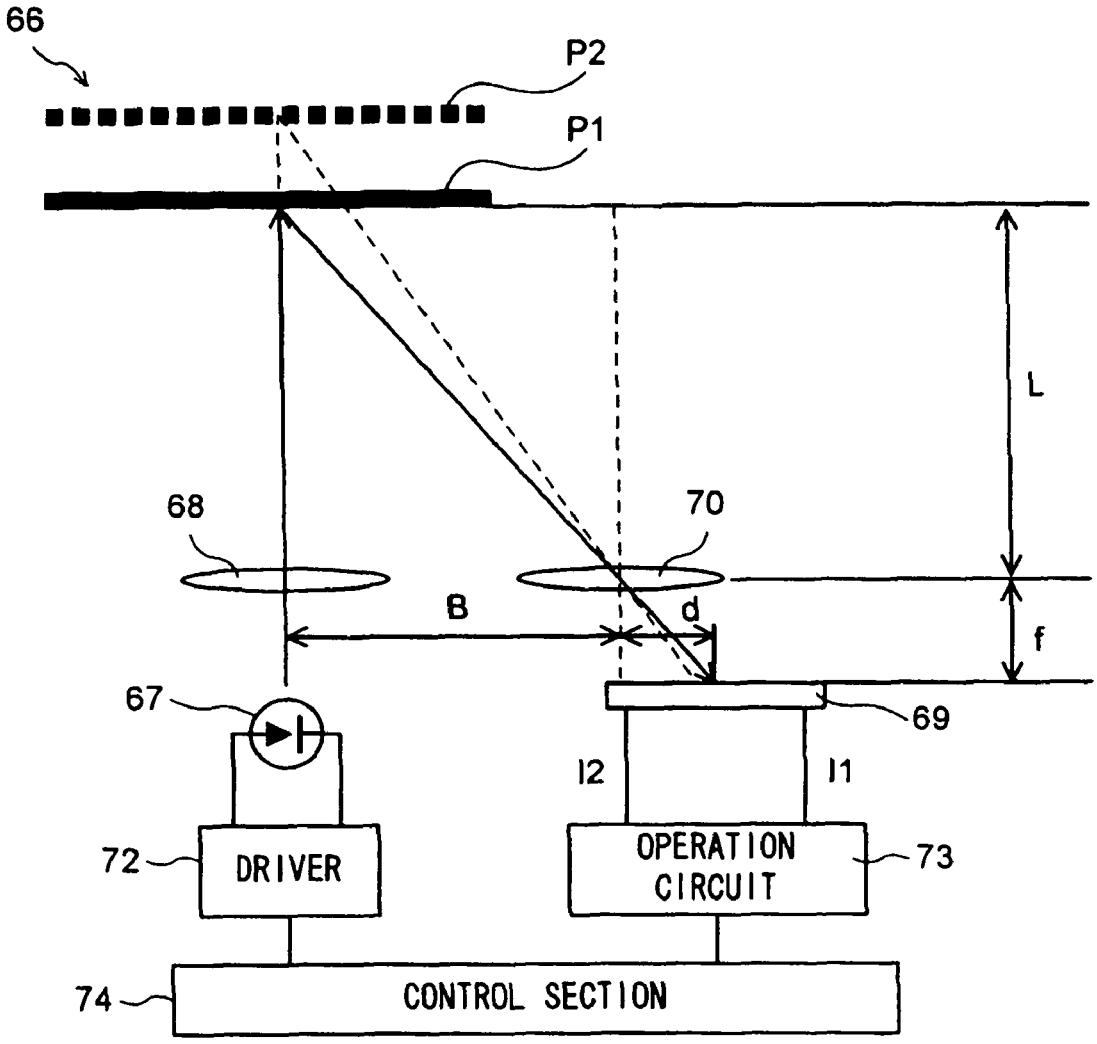
FIG. 3 is a side view conceptually showing a structure of the distance detecting unit embodying the present invention.

A detailed description will be given of the distance detecting unit 66 with reference to FIG. 3. FIG. 3 is a side view conceptually showing a structure of the distance detecting unit of embodying the present invention.

The distance detecting unit 66 has: a light source 67 and a light projecting lens 68 that serve as a light projector; a PSD (position sensitive detector) element 69 and a light receiving lens 70 that serve as a photodetector; a driver circuit 72 for driving the light source 67; and an operation circuit 73 for calculating a distance based on a reflected light signal of the PSD element 69. The driver circuit 72 and the operation circuit 73 are controlled by a control section 74 that will be described later.

The light projector and the photodetector are arranged next to each other in an axis direction of the secondary transfer roller 34 (see FIG. 2) (a longitudinal direction of the apparatus). In the light projector, the light source 67 that is an infrared emitting diode is driven by the control section 74 via the driver circuit 72, and light emitted therefrom is collected by the light projecting lens 68 to be projected toward the paper P. In the photodetector, light reflected from the paper P is collected by the light receiving lens 70 to be incident on the PSD element 69. Here, an incident angle at which the light reflected from the paper P is incident on the light receiving lens 70 varies according to where the light is reflected (thus, distances P1, P2 between the light source and the paper P along an optical axis), and accordingly a position at which the reflected light is collected on the PSD element 69 also varies.

The PSD element 69 has an elongate photodiode and output terminals at two ends of the photodiode. In the photodiode, carriers appear at a position at which light is incident thereon, and the carriers move to the two ends of the photodiode, and as a result, a current flows at each of the output terminals. Here, the current at each of the two output terminals varies according to a resistance that corresponds to a distance therefrom to the position at which the carriers have appeared. In this way, the PSD element 69 converts light reflected from paper into a current proportional to the intensity of the light reflected from the paper, and further divides the current into two current signals I1 and I2 at a ratio depending on an incident position "d" at which the light reflected from the paper is incident on the PSD element 69. These output currents I1 and I2 are amplified and fed to the operation circuit 73, where the incident position "d" at which the light reflected from the paper P is incident on the PSD element 69 is calculated based on a current ratio between the output currents I1 and I2. The operation circuit 73 further calculates the distance to the paper P based on the incident position "d" and optical constants of the light projector and the photodetector.

That is, as shown in FIG. 3, the light projector and the photodetector are arranged such that a distance from the light receiving lens 70 to a light receiving face of the PSD element 69 is "f" and a distance from the light receiving lens 70 to an optical axis of the light projecting lens 68 is "B". Light reflected from a measurement surface located at a distance "L" from the light receiving lens 70 is focused by the light receiving lens 70 and is incident on the PSD element 69 at the incident position "d". The incident position "d" of the light reflected from the measurement surface varies in a right-left direction in FIG. 3 as the distance "L" varies. Based on an output value from the PSD element 69 corresponding to the incident position "d", the output value being known in advance from optical constants such as "B" and "f" shown in the figure and a characteristic of the PSD element, the operation circuit 73 calculates the distance "L" to the measurement surface (the paper P), and feeds the obtained data of the distance "L" to the control section 74.

Figure 4:
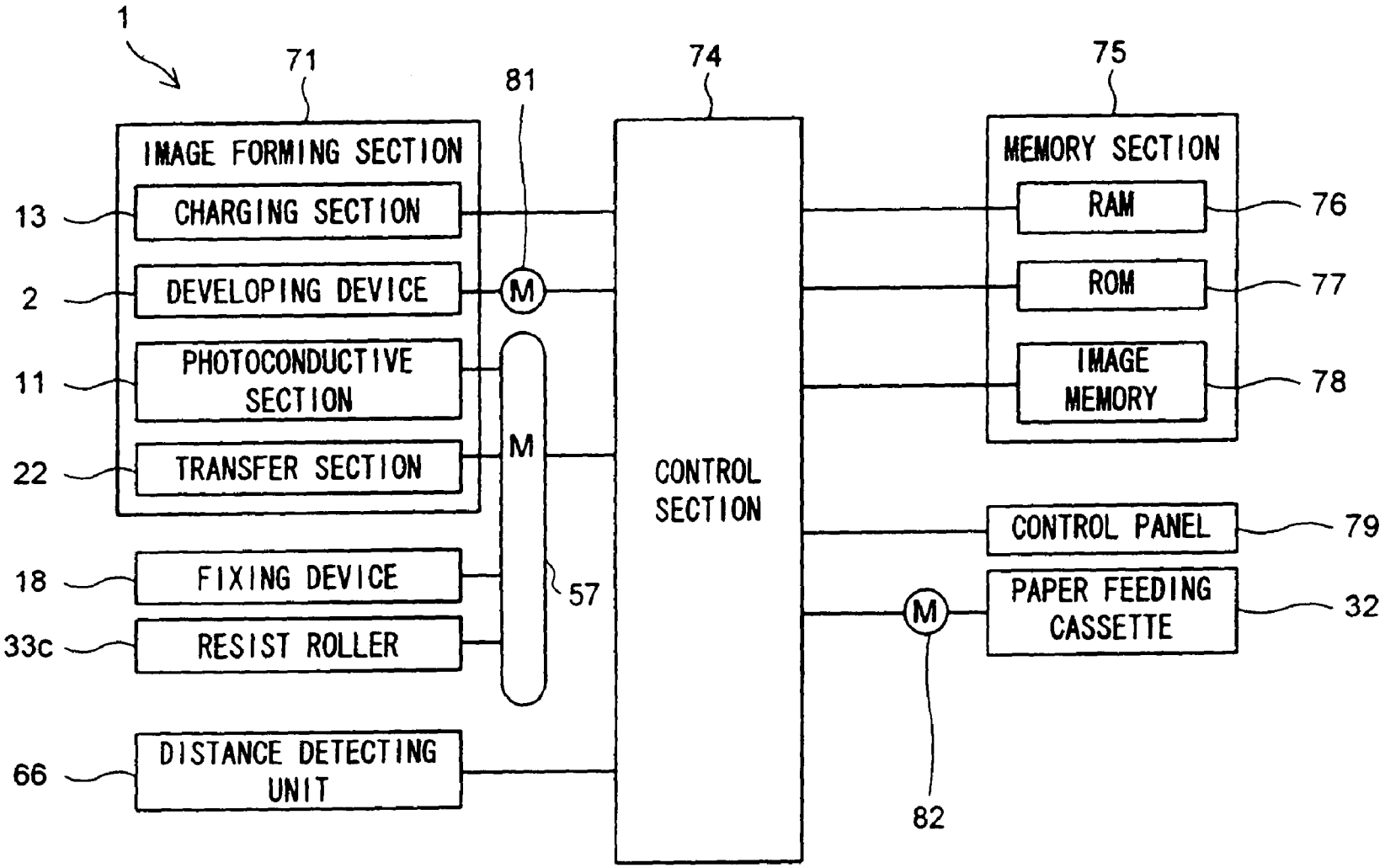
FIG. 4 is a block diagram showing a structure of an image forming apparatus embodying the present invention.

Next, a description will be given of how a main part of an image forming apparatus is controlled by a control section with reference to FIG. 4. FIG. 4 is a block diagram showing a structure of an image forming apparatus provided with a control section.

An image forming apparatus 1 is provided with a charging section 13, a developing device 2, and an image forming section 71 including a photoconductive section 11 and a transfer section 22 such as an intermediate transfer belt. The image forming apparatus 1 is also provided with a fixing device 18, driving means 57 that drives the photoconductive section 11 and the transfer section 22, a developing motor 81, and a paper-feeding motor 82. The image forming apparatus 1 is further provided with a control section 74, a memory section 75, and a control panel 79.

The memory section 75 is provided with a RAM 75, a ROM 77, and an image memory 78; the RAM 75 and the ROM 77 store processing programs, contents of processing, and the like. The image memory 78 stores data of images such as letters and pictures fed to an image input section from, for example, a personal computer. The ROM 77 also stores distances L1 and L2 (see FIG. 2) indicating a normal transportation range of paper P that is sent out from a secondary transfer section S.

The control panel 79 is composed of a control portion (not shown) having a plurality of control keys and a display portion (not shown) for displaying setting conditions, a state of the apparatus, and the like. Through the control panel 79, the user turns on/off the power supply to the apparatus and sets, for example, printing conditions such as a paper size, a paper type, and a number of sheets to be printed. Also, in a case where the image forming apparatus 1 has a facsimile function, facsimile destinations can be registered in the memory section 75 through the control panel 79, and further, various settings can be carried out, such as reading and rewriting the registered facsimile destinations.

The developing motor 81 drives a toner agitation screw and a developing roller placed inside the developing device 2 in response to a control signal from the control section 74. The paper feeding motor 82 drives a paper feeding roller inside a paper feeding cassette 32 in response to a control signal from the control section 74.

The driving means 57 is provided with a motor, a deceleration gear, a clutch, and the like, and rotatably drives the photoconductive section 11, a driving roller 25 (see FIG. 1) of the transfer section 22, a roller of the fixing device 18, and a resist roller 33*c*. The resist roller 33*c* is linked to a motor via a clutch so as to be driven independently of the photoconductive section 11 and the driving roller of the transfer section 22, and, in response to a control signal from the control section 74, supplies the secondary transfer section S with paper at a predetermined timing.

The control section 74 is formed with, for example, a microcomputer, and generally controls the image forming section 71, the fixing device 18, the motors 81 and 82, and the driving means 57 according to the processing programs stored in the RAM 76 and the ROM 77.

Next, with reference to FIG. 4 as well as FIGS. 2 and 3, a description will be given of how the control section 74 judges the distance to the paper P and controls the driving of the driving means 57 according to the judgment.

When the control section 74 receives an image-formation-starting signal inputted via the control panel 79, the control section 74 activates a driver circuit 72 of a distance detecting unit 66 to allow the distance detecting unit 66 to be ready to perform distance detection, and the control section 74 also activates the driving means 57, which rotatably drives the photoconductive section 11, the driving roller 25 of the transfer section 22, and the fixing device 18.

Electrostatic latent images formed at the photoconductive section 11 are developed into toner images by the developing device 2, and the toner images at the photoconductive section 11 are transferred onto an intermediate transfer belt 17 one after another. When the control section 74 moves the clutch of the driving means 57 at a timing in accordance with a transfer performed with respect to this intermediate transfer belt 17, the resist roller 33*c* is linked to the motor to rotate to allow the paper P to be transported to the secondary transfer section S, where the toner image formed on the surface of the intermediate transfer belt 17 is transferred onto the paper P and then the paper P is sent out from the secondary transfer section S toward the fixing device 18.

The distance detecting unit 66 detects a distance "L" to the paper P that passes above the distance detecting unit 66 when a predetermined time period has passed after prediction of a position of an edge of the paper P based on the rotatable driving of the resist roller 33*c*, and feeds a distance signal representing the distance to the control section 74. The control section 74 compares the distance signal fed from the distance detecting unit 66 and distances "L1" and "L2" indicating a normal transportation range, which are stored in the ROM 77. When the distance represented by the distance signal is found not to be shorter than "L1" and not to be longer than "L2" from the comparison result, the control section 74 judges that the paper P has been normally sent out from the secondary transfer section S, and allows the driving means 57 to continue operating; thus the paper P is transported to the fixing device 18, where it is subjected to fixing. On the other hand, when the distance represented by the distance signal is found to be shorter than the distance "L1" from the comparison result, the control section 74 judges that the paper P has not been normally sent out from the secondary transfer section S; then, the control section 74 makes the driving means 57 stop operating and makes a jam-display on the display portion of the control panel 79 to urge the user to deal with the jam. When the distance represented by the distance signal is found to be longer than the distance "L2" from the comparison result, the control section 74 judges that the paper P has not been normally sent out from the secondary transfer section S, the paper P remaining adhered to the intermediate transfer belt 17 or being in a state such that it is likely to hit or rub against a belt cleaning unit 31, and the control section 74 makes the driving means 57 stop operating and makes a jam-display on the display portion of the control panel 79 to urge the user to deal with the jam.

According to the embodiment described above, the image forming apparatus 1 has the intermediate transfer belt 17 that rotates in synchronization with the operation of the photoconductive section 11 where toner images are formed and the secondary transfer section (separation section) S at which the paper P temporarily adhered to the surface of this intermediate transfer belt 17 can be separated from the surface of the intermediate transfer belt 17. The provision of the distance detecting unit 66 that detects the distance "L" to the paper P that is sent out from the secondary transfer section S and the control section 74 that judges whether or not the paper P is normally separated from the secondary transfer section S based on the distance data from this distance detecting unit 66 makes it possible to detect the paper P sent out from the secondary transfer section S not only remaining adhered to the intermediate transfer belt but also moved forward in an inappropriate direction from the secondary transfer section S, and as a result, various types of separation failure of the paper P occurring at the secondary transfer section S can be easily judged.

Also, according to the embodiment described above, the control section 74 makes the intermediate transfer belt 17 stop rotating when the distance represented by the distance data fed from the distance detecting unit 66 is longer than the predetermined distance "L2". In this way, the paper P is detected not only remaining adhered to the intermediate transfer belt 17 at the secondary transfer section S but also being in a state such that it is likely to hit or rub against members and units such as the belt cleaning unit 31 arranged in the vicinity of the paper transportation path between the secondary transfer section S and the fixing device 18, and, according to the detection result, the control section 74 can make the intermediate transfer belt 17 stop rotating, making it possible to deal with various types of jams. This makes it possible to reduce space necessary for allowing paper to avoid hitting or rubbing against members and units arranged in the vicinity of the paper transportation path, and thus to make the apparatus compact.

Also, according to the embodiment described above, the distance detecting unit 66 has the light projector that projects light toward the paper P and the photodetector that receives light reflected from the paper P, and detects the distance to the paper P based on a position in the photodetector at which light reflected from the paper P is received; as a result, the distance detecting unit 66 can accurately detect the distance to the paper P.

Also, according to the embodiment described above, since the distance detecting unit 66 is placed in the vicinity of the secondary transfer section S, abnormal transportation of the paper P can be detected as soon as the paper P is sent out from the secondary transfer section S; this eliminates the possibility of the paper P being sent to a position from which it is difficult to remove paper, which makes it easy to deal with a jam.

Also, according to the embodiment described above, the distance detecting unit 66, as a result of being arranged to be perpendicular to the plane defined by the secondary transfer section S and the bottom end 31*c* of the casing of the belt cleaning unit 31, detects, in the direction perpendicular to the paper P, the distance to the paper P when it is likely to hit or rub against the casing of the belt cleaning unit 31. That is, the variation in distance to paper is equal to the variation in distance from paper to the detecting unit 66 in the direction of the optical axis of the distance detecting unit 66, and thus the distance can be detected even more accurately, which helps improve the accuracy with which it is judged whether or not the paper P is likely to hit or rub against the casing of the belt cleaning unit 31.

The embodiment described above deals with an example where the present invention is applied to a structure in which primary transfer is performed onto the intermediate transfer belt 17 at a primary transfer section, which is between the photoconductive section 11 and the intermediate transfer belt 17, a toner image on the intermediate transfer belt 17 is secondarily transferred onto the paper P at the second transfer section S, and the paper P is sent out from the secondary transfer section S. This, however, is not meant to limit the present invention, and the present invention may be applied to a structure in which the paper P is transported by being electrostatically adhered to a belt-shaped or a drum-shaped paper transporting member that rotates in synchronization with the photoconductive section 11, and after toner images are transferred onto the paper P from the photoconductive section 11, the paper P having the toner images transferred thereon is sent out from the paper transporting member.

The present invention can be used in image forming apparatuses employing electrographic method, such as copiers, printers, facsimiles, and multifunctional systems having these functions, and more specifically, the present invention can be used in image forming apparatuses having a belt-shaped rotatable member such as an intermediate transfer member and a paper transporting member.

What is claimed is:

1. An image forming apparatus, comprising:

a belt-shaped rotatable member that rotates in synchronization with operation of an image forming member on which an image is formed;

a separation section at which paper adhered to a surface of the belt-shaped rotatable member can be separated from the surface of the belt-shaped rotatable member;

a distance detecting unit that detects a distance to paper sent out from the separation section; and a control section that judges, based on distance data fed from the distance detecting unit, whether or not paper is appropriately separated from the separation section.

2. The image forming apparatus of claim 1, wherein the distance detecting unit includes:

a light projector that projects light toward paper; and a photodetector that receives light reflected from the paper, and the distance detecting unit detects a distance to the paper based on a position in the photodetector at which the light reflected from the paper is received.

3. The image forming apparatus of claim 1, wherein the control section makes the belt-shaped rotatable member stop rotating when the distance data is out of a predetermined range.

4. The image forming apparatus of claim 1, wherein the control section displays an alert on a control panel when the distance data is out of a predetermined range.

5. The image forming apparatus of claim 1, wherein the belt-shaped rotatable member is an intermediate transfer belt onto which a toner image formed on the image forming member is primarily transferred, and the separation section is a secondary transfer section at which the toner image on the intermediate transfer belt is secondarily transferred onto paper.

6. The image forming apparatus of claim 1, wherein the distance detecting unit is placed in a vicinity of the separation section.

7. The image forming apparatus of claim 5, wherein a belt cleaning unit for removing residual toner remaining on a surface of the intermediate transfer belt after a secondary transfer is placed in a vicinity of the secondary transfer section, and the distance detecting unit is placed between the secondary transfer section and the belt cleaning unit.

8. The image forming apparatus of claim 7, wherein the distance detecting unit is arranged so as to be perpendicular to a plane defined by the secondary transfer section and a lower edge of the belt cleaning unit.

9. The image forming apparatus of claim 1, wherein a transportation guide is provided for guiding paper sent out from the separation section toward a fixing device, and the distance detecting unit detects a distance to paper while the paper is present between the separation section and a position where the paper is guided by the transportation guide.

10. The image forming apparatus of claim 9, wherein the control section makes the belt-shaped rotatable member stop rotating when the distance data is out of a predetermined range.

11. The image forming apparatus of claim 9, wherein the control section displays an alert on a control panel when the distance data is out of a predetermined range.

12. The image forming apparatus of claim 1, wherein the belt-shaped rotatable member is a paper transporting member that transports paper toward the image forming member, and further transports the paper to the separation section after a toner image is transferred onto the paper from the image forming member.

13. The image forming apparatus of claim 12, wherein the control section makes the paper transporting member stop rotating when the distance data is out of a predetermined range.

14. The image forming apparatus of claim 12, wherein the control section displays an alert on a control panel when the distance data is out of a predetermined range.

* * * * *